US006663409B1

(12) United States Patent
Liao et al.

(10) Patent No.: US 6,663,409 B1
(45) Date of Patent: Dec. 16, 2003

(54) ZERO INSERTION FORCE SOCKET HAVING A BASE WITH COMPLIANT WALLS

(75) Inventors: Fang-Jun Liao, Tu-chen (TW); Hsiu-Yuan Hsu, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/293,127

(22) Filed: Nov. 12, 2002

(30) Foreign Application Priority Data

Jun. 28, 2002 (TW) ..... 91209755 U

(51) Int. Cl.[7] ..... H01R 13/627; H01R 13/62; H01R 13/44

(52) U.S. Cl. ..... 439/342; 439/259; 439/135

(58) Field of Search ..... 439/342, 259, 439/135, 140, 262

(56) References Cited

U.S. PATENT DOCUMENTS 5,876,217 A * 3/1999 Ito et al. ..... 439/74
6,425,771 B1 * 7/2002 Shirai et al. ..... 439/83
6,533,613 B1 * 3/2003 Turner et al. ..... 439/608

* cited by examiner

*Primary Examiner*—Chandrika Prasad
(74) *Attorney, Agent, or Firm*—Wei Te Chung

(57) ABSTRACT

A zero insertion force socket (1) for electrically connecting a central processing unit (CPU) (2) with a circuit board. The socket includes a base (10), a cover (11) slidably mounted on the base, and terminals (14) received in corresponding passageways (130) defined through the base for electrically connecting pins (21) of the CPU with the circuit board. The base has walls (131) respectively between every two adjacent passageways. Blind cavities (1310) are respectively defined in the walls, with openings of the cavities facing the cover. When the cover is slid to a closed position, the CPU may be pushed too far along the base by the cover. When this happens, some pins may bear against corresponding walls of the base. Because the cavities are defined in the walls, the walls deflect under pressure from the pins. Thus the risk of the damage to the pins is minimized.

16 Claims, 6 Drawing Sheets

ZERO INSERTION FORCE SOCKET HAVING A BASE WITH COMPLIANT WALLS

BACKGROUND OF THE INVENTION

1. Field of the Invention

The present invention relates to a zero insertion force (ZIF) socket for electrically connecting an electronic package such as a pin array (PGA) chip with a circuit substrate such as a printed circuit board (PCB), and particularly to a ZIF socket having a base with resiliently deformable walls.

2. Description of the Prior Art

Electrical sockets are widely used in the connector industry for electrically connecting central processing units (CPUs) to printed circuit boards (PCBs) in personal computers (PCs). One kind of electrical socket is disclosed in "1996 IEEE 46$^{th}$ Electronic Components & Technology Conference" and in U.S. Pat. No. 4,988,310. Referring to FIGS. 6 and 7, the electrical socket is designed for electrically interconnecting a CPU 8 with a PCB (not shown). The socket 9 comprises a dielectric base 91, a cover 92 slidably mounted on the base 91, and an actuation device 93 engaged with the base 91 and the cover 92. The CPU 8 comprises a multiplicity of pins 81. The CPU 8 is attached on the cover 92, with the pins 81 extending through the cover 92. By turning the actuation device 93, the cover 92 moves along the base 91 between a closed position and an open position. The CPU 8 and the PCB correspondingly electrically connect or disconnect. The base 91 comprises a multiplicity of passageways 96 for receiving a multiplicity of conductive contacts 95. The base 91 has a wall 97 between each two adjacent passageways 96. The socket 9 is used to transmit electrical signals by way of electrical current between the CPU 8 and the PCB. The accompanying voltage may be so high that it causes the electrical current to jump across the wall 97 from one contact 95 to another contact 95. This frequently results in failure of signal transmission between the CPU 8 and the PCB, and even damage to the CPU 8.

To solve this problem, the walls 97 of the socket 9 are designed to be thick enough to space the contacts 95 apart a sufficient distance. This minimizes the risk of electrical current jumping from one contact 95 to another contact 95. However, the pins 81 of the CPU 8 may not be precisely positioned in the passageways 96. In particular, the CPU 8 may be pushed too far along the base 91 by the cover 92. As a result, the pins 81 may bear against the walls 97 of the base 91. Because the walls 97 are thick and rigid, the pins 81 are liable to be deflected and even damaged by the walls 97. In addition, an unduly large amount of material is required to make the base 91 having the thick walls 97. Furthermore, the walls 97 make the base 91 unduly heavy. U.S. Pat. Nos. 5,443,591 and 5,456,612 disclose conventional sockets which have disadvantages similar to the disadvantages described above.

A new electrical socket which overcomes the above-mentioned problems is desired.

SUMMARY OF THE INVENTION

An object of the present invention is to provide a ZIF socket having a base with walls that minimize the risk of accidental damage to pins of an associated CPU.

Another object of the present invention is to provide a ZIF socket having a base with walls whereby manufacturing and transportation costs of the socket are reduced.

To achieve the above objects, a ZIF socket of the present invention is for electrically connecting a central processing unit (CPU) with a mother board. The socket comprises a dielectric base, a cover slidably mounted on the base, and a multiplicity of terminals received in corresponding passageways defined through the base for electrically connecting pins of the CPU with the mother board. The cover defines a multiplicity of holes therein, for receiving the pins of the CPU therethrough. The base has a multiplicity of walls respectively between every two adjacent passageways along a direction of sliding of the cover. A multiplicity of blind cavities is respectively defined in the walls, with openings of the cavities facing the cover. When the cover is slid to a closed position, the CPU may be pushed too far along the base by the cover. When this happens, some pins may bear against corresponding walls of the base. Because the cavities are defined in the walls, the walls deflect under pressure from the pins, rather than resisting such pressure. Thus the risk of damage to the pins when the CPU is pushed too far by the cover is minimized.

Other objects, advantages and novel features of the invention will become more apparent from the following detailed description when taken in conjunction with the accompanying drawings, in which:

DESCRIPTION OF THE PREFERRED EMBODIMENTS

Reference will now be made to the drawings to describe the present invention in detail.

Figure 1:
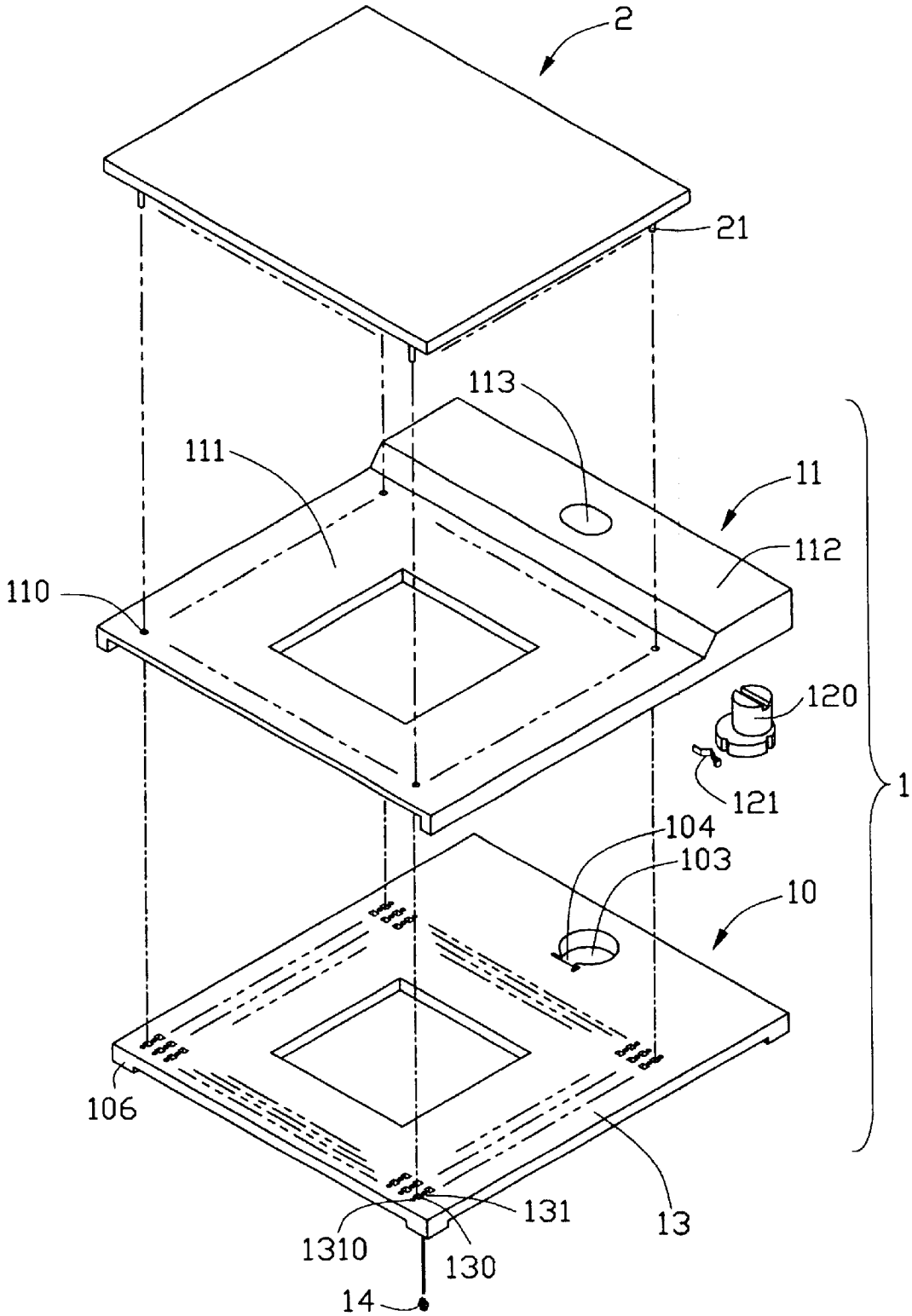
FIG. 1 is an exploded isometric view of a ZIF socket in accordance with a preferred embodiment of the present invention, together with a CPU.
Figure 2:
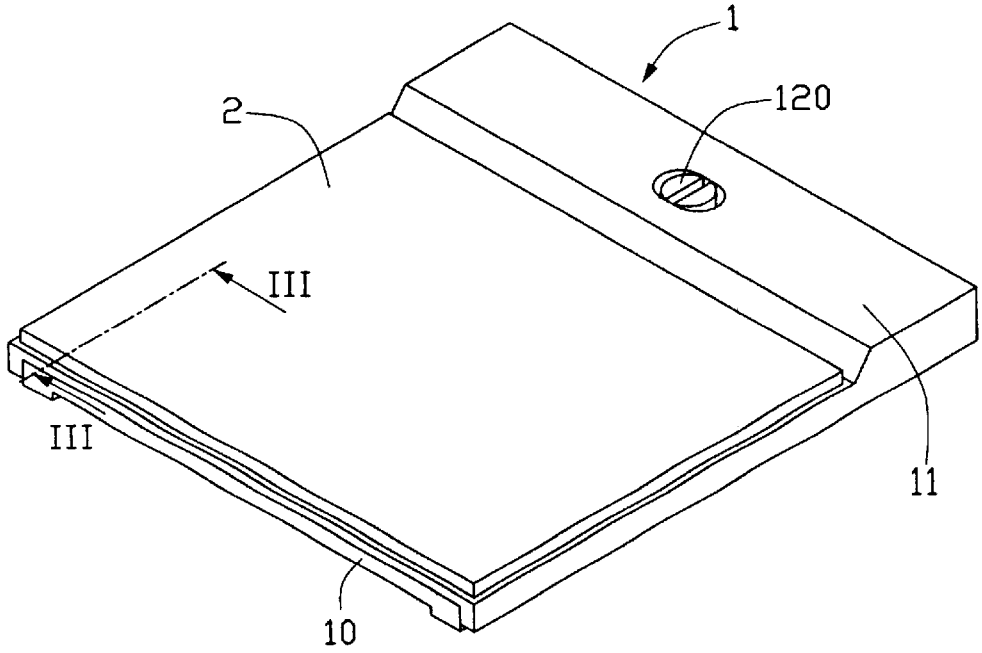
FIG. 2 is an assembled view of FIG. 1.
Figure 3:
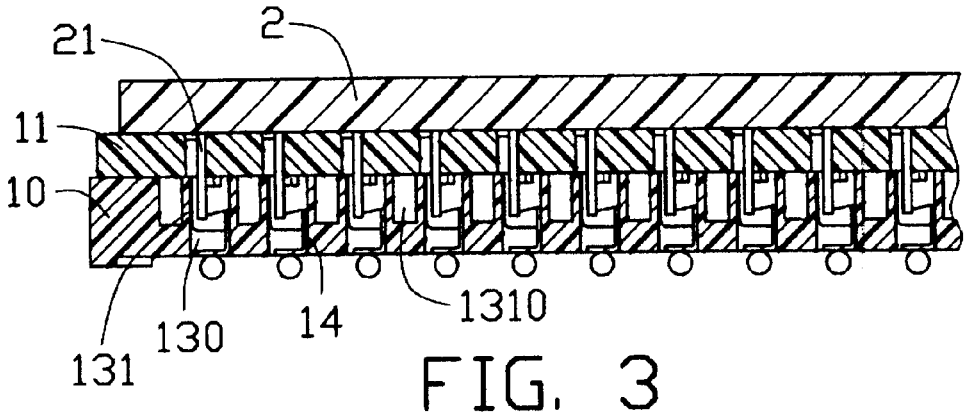
FIG. 3 is a cross-sectional view taken along line III—III of FIG. 2.

Referring to FIGS. 1, 2 and 3, a ZIF socket 1 in accordance with a preferred embodiment of the present invention comprises a dielectric base 10, a cover 11 slidably mounted on the base 10, and a multiplicity of terminals 14 received in corresponding passageways 130 defined through the base 10 for electrically connecting pins 21 of a central processing unit (CPU) 2 with a mother board (not shown).

The cover 11 of the socket 1 comprises a supporting plate 111, and a raised portion 112 formed at one side of the supporting plate 111. The raised portion 112 defines a generally elliptical aperture 113 in a middle portion thereof. The supporting plate 111 defines a multiplicity of holes 110 therein, for receiving the pins 21 of the CPU 2 therethrough.

The base 10 comprises four standoffs 106 at a bottom of four corners thereof respectively. A circular hole 103 is defined in a front portion of the base 10, corresponding to the aperture 113 of the cover 11. An L-shaped groove 104 is defined in the base 10 rearwardly of and in communication with the aperture 113. The passageways 130 of the base 10 correspond to the holes 110 of the cover 11. The base 10 has a multiplicity of walls 131 respectively between every two adjacent passageways 130 along a direction of sliding of the cover 11. A multiplicity of blind cavities 1310 is respectively defined in the walls 131, with openings of the cavities 1310 facing the cover 11. A cam 120 is received in the circular hole 103 and the aperture 113, for actuating the cover 11 to slide along the base 10. A resilient tab 121 is received in the L-shaped groove 104, for fixing the cam 120 in the circular hole 103 and the aperture 113.

In assembly, the cover 11 is mounted on the base 10. The cam 120 is received in the circular hole 103 and the aperture 113. The resilient tab 121 is received in the groove 104. By turning the cam 120 with a tool such as a screwdriver, the cover 11 slides along the base 10 between an open position and a closed position. When the cam 120 is rotated to actuate the cover 11 to slide to the open position, the CPU 2 is able to be attached on the socket 1. The pins 21 of the CPU 2 are inserted into the corresponding passageways 130 of the base 10 via the holes 110 of the cover 11. When the cam 120 is rotated to slide the cover 11 to the closed position, the pins 21 of the CPU 2 are pushed by the cover 11 to mechanically and electrically engage with the terminals 14 of the socket 1.

Figure 4:
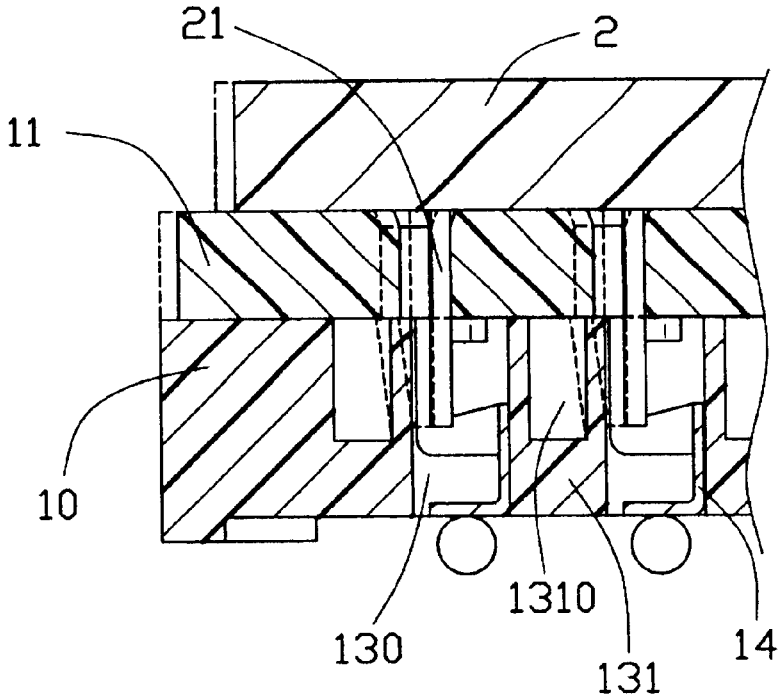
FIG. 4 is an enlarged view of part of FIG. 3, also showing positions of certain components in dashed lines in the case where the CPU has been pushed too far along a base of the socket.

Referring to FIG. 4, when the cover 11 is slid to the closed position, some of the pins 21 of the CPU 2 may not be precisely positioned in their correct locations in the passageways 130. In particular, the CPU 2 may be pushed too far along the base 10 by the cover 11. When this happens, the pins 21 may bear against corresponding walls 131 of the base 10. Because the cavities 1310 are defined in the walls 131, the walls 131 are thin enough to be resiliently compliant. The walls 131 deflect under pressure from the pins 21, rather than resisting such pressure. Thus the risk of damage to the pins 21 when the CPU 2 is pushed too far by the cover 11 is minimized. In addition, the cavities 1310 result in less material being needed for making the base 10, and make the socket 1 lighter. This can reduce manufacturing and transportation costs of the socket 1.

Figure 5:
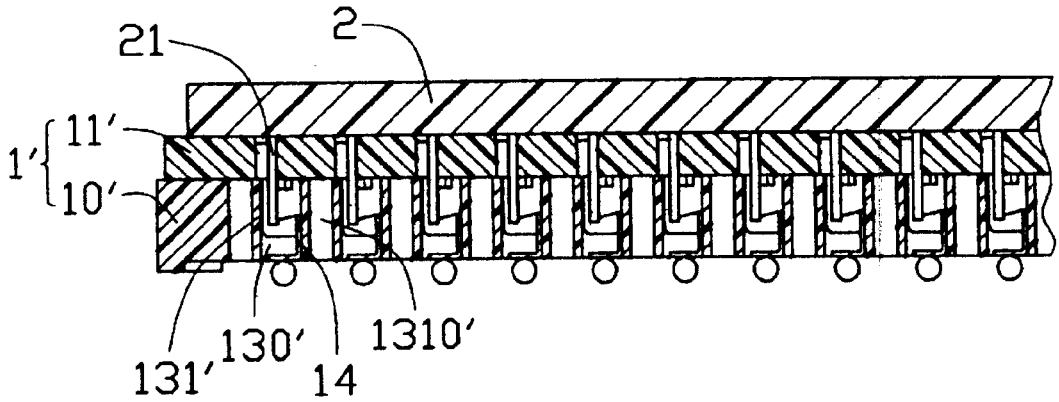
FIG. 5 is similar to FIG. 3, but showing a ZIF socket in accordance with an alternative embodiment of the present invention.
Figure 6:
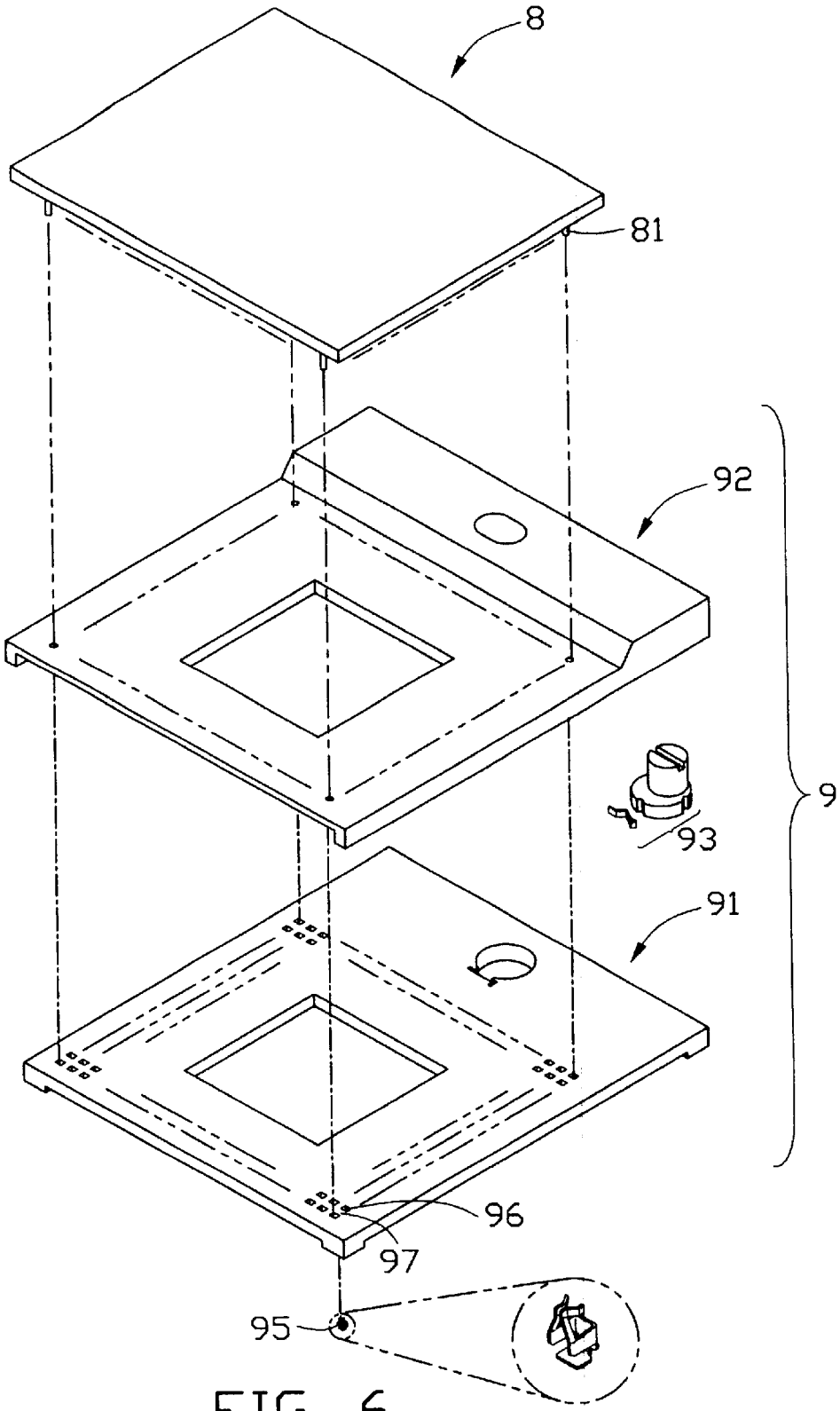
FIG. 6 (PRIOR ART)
FIG. 6 is an exploded isometric view of a conventional ZIF socket, together with a CPU.
Figure 7:
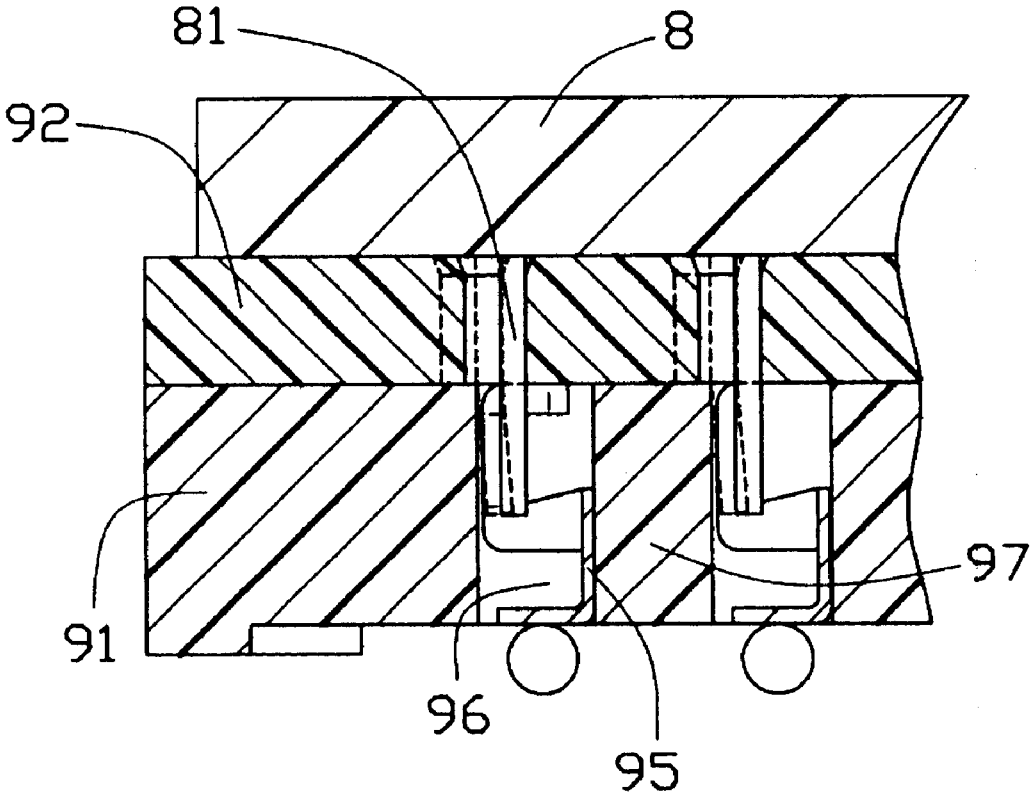
FIG. 7 (PRIOR ART)
FIG. 7 is a partial cross-sectional view of the socket and CPU of FIG. 6 fully assembled, also showing positions of certain components in dashed lines in the case where the CPU has been pushed too far along a base of the socket.

Referring to FIG. 5, a ZIF socket 1' in accordance with an alternative embodiment of the present invention has a structure similar to that of the socket 1 of the preferred embodiment. The socket 1' comprises a base 10' defining a multiplicity of passageways 130' therethrough. The base 10' has a multiplicity of walls 131' respectively between every two adjacent passageways 130' along a direction of sliding of a cover 11'. A multiplicity of cavities 1310' is defined through the walls 131', with each cavity spanning from a top surface to a bottom surface of the base 10'. Some of the pins 21 of the CPU 2 may not be precisely positioned when the CPU 2 is pushed too far along the base 10' by the cover 11'. When this happens, the pins 21 may bear against the walls 131' of the base 10'. Because the cavities 1310' are defined through the walls 131', the walls 131' are thin enough to be resiliently compliant. The walls 131' deflect under pressure from the pins 21, rather than resisting such pressure. Thus the risk of the damage to the pins 21 when the CPU 2 is pushed too far by the cover 11' is minimized. In addition, the cavities 1310' result in less material being needed for making the base 10', and make the socket 1' lighter. This can reduce manufacturing and transportation costs of the socket 1'.

While preferred embodiments in accordance with the present invention have been shown and described, equivalent modifications and changes known to persons skilled in the art according to the spirit of the present invention are considered within the scope of the present invention as defined in the appended claims.

What is claimed is:

1. An electrical connector for electrically connecting an electronic package with a circuit substrate, the connector comprising:

a dielectric base defining a plurality of passageways adapted to receive a plurality of conductive terminals therein; and a cover slidably mounted on the base and adapted to receive a plurality of pins of the electronic package along a first direction and push the pins along a second direction substantially perpendicular to the first direction;

wherein the base has walls arranged respectively between every two adjacent passageways along the second direction, at least one empty cavity is defined in each of the walls, and each of the walls can elastically deform under pressure from a corresponding pin of the electronic package.

2. The electrical connector as claimed in claim 1, wherein at least one of the empty cavities is a blind cavity.

3. The electrical connector as claimed in claim 1, wherein at least one of the empty cavities spans between opposite surfaces of the base.

4. The electrical connector as claimed in claim 1, wherein the socket comprises a cam mounted in the cover and the base.

5. The electrical connector as claimed in claim 1, wherein the cover slides along the base between an open position and a closed position, and in the closed position, the pins of the electronic package mechanically and electrically engage with the terminals of the base.

6. An electrical assembly comprising:

a socket comprising a dielectric base defining a plurality of passageways receiving a plurality of terminals therein, and a cover slidably mounted on the base and defining a plurality of holes in general alignment with the passageways respectively, the passageways being arranged in rows along a direction of sliding of the cover, the base having walls respectively between every two adjacent passageways, at least one empty cavity being defined in each of the walls; and an electronic package attached on the cover, the electronic package having a plurality of pins received in corresponding passageways of the base via corresponding holes of the cover; wherein each of the walls can deflect when a corresponding pin of the electronic package bears against the wall.

7. The electrical assembly as claimed in claim 6, wherein at least one of the empty cavities is a blind cavity.

8. The electrical assembly as claimed in claim 6, wherein at least one of the empty cavities spans between opposite surfaces of the base.

9. The electrical assembly as claimed in claim 6, wherein a cam is arranged in the cover and the base.

10. The electrical assembly as claimed in claim 6, wherein the cover slides along the base between an open position and a closed position, and in the closed position, the pins of the electronic package mechanically and electrically engage with the terminals of the base.

11. An electrical connector assembly comprising:

an electrical socket including a base defining a mating face thereon and a plurality of passageways extending in a first direction;

a plurality of terminals received within the corresponding passageways, respectively;

a plurality of empty cavities located in the base beside the corresponding passageways, respectively; and an electronic component located above said mating face and including a plurality of conductive pins extending therefrom along said first direction and into the corresponding passageways, respectively, and engaged with the corresponding terminals, respectively; wherein each of said empty cavities is respectively spaced from the corresponding pin with a partition wall therebetween, said empty cavity rendering the partition wall deflectable in a second direction perpendicular to said first direction when the corresponding pin is moved too far along said second direction and hits the partition wall.

12. The assembly as claimed in claim 11, wherein said empty cavities do not extend through said base along said first direction.

13. The assembly as claimed in claim 12, wherein said empty cavities are formed around the mating face.

14. The assembly as claimed in claim 11, wherein said socket includes a cover moveably mounted on the base along said second direction and located between the electronic component and the base, and said cover defines a plurality of through holes in respective alignment with the corresponding passageways, through which the corresponding pins extend, respectively.

15. The assembly as claimed in claim 11, wherein said electronic component is a central processing unit.

16. The assembly as claimed in claim 11, wherein each of said cavities is only located between every corresponding adjacent two passageways along said second direction.

* * * * *